US006117388A

United States Patent [19]

Shibata et al.

[11] Patent Number: 6,117,388

[45] Date of Patent: Sep. 12, 2000

[54] HOT WORKING DIE STEEL AND MEMBER COMPRISING THE SAME FOR HIGH-TEMPERATURE USE

[75] Inventors: Takashi Shibata; Eiji Maeda, both of Hokkaido, Japan

[73] Assignee: The Japan Steel Works, Ltd., Tokyo, Japan

[21] Appl. No.: 09/262,843

[22] Filed: Mar. 5, 1999

[30] Foreign Application Priority Data

Sep. 2, 1998 [JP] Japan ..... 10-248749

[51] Int. Cl.[7] ..... C22C 38/22; C22C 38/30; C22C 38/44; C22C 38/52

[52] U.S. Cl. ..... 420/37; 420/38; 420/69; 420/105; 420/107

[58] Field of Search ..... 420/37, 38, 107, 420/69; 148/105, 325, 330, 333

[56] References Cited

U.S. PATENT DOCUMENTS 4,171,233 10/1979 Vander Voort .

FOREIGN PATENT DOCUMENTS 46-19774 6/1971 Japan ..... 420/107

*Primary Examiner*—Deborah Yee
*Attorney, Agent, or Firm*—Sughrue, Mion, Zinn, Macpeak & Seas, PLLC

[57] ABSTRACT

Alloy steel containing 0.10 to 0.50 wt % of C, 0.5 wt % or less of Si, 1.5 wt % or less of Mn, 1.5 wt % or less of Ni, 3.0 to 13.0 wt % of Cr, 0 to 3.0 wt % of Mo, 1.0 to 8.0 wt % of W, 0.01 to 1.0 wt % of V, 0.01 to 1.0 wt % of Nb, 1.0 to 10.0 wt % of Co, 0.003 to 0.04 wt % of B, and 0.005 to 0.05 wt % of N, the balance comprising Fe and unavoidable impurities.

17 Claims, 2 Drawing Sheets

HOT WORKING DIE STEEL AND MEMBER COMPRISING THE SAME FOR HIGH-TEMPERATURE USE

BACKGROUND OF INVENTION

1. Field of the Invention

This invention relates to hot working die steel for use in relatively high temperature and members for high-temperature use comprising the hot working die steel, such as a casting die, a structural member for a casting machine, an injection die, a structural member for an injection molding machine, a hot forging die, an extrusion die, and the like.

2. Related Art

Where a light metal or an alloy mainly comprising a light metal (hereinafter inclusively referred to as light metal), such as aluminum, an aluminum alloy, magnesium or a magnesium alloy, or a low-melting metal or an alloy mainly comprising a low-melting metal (hereinafter inclusively referred to as low-melting metal), such as lead, a lead alloy, tin or a tin alloy, is manufactured by casting, JIS-SKD J61 steel of 5% Cr type has been used as a casting die or a structural member of a casting machine that is to be exposed to high temperature. Injection molding has been recently introduced in the manufacture of the light metals or low-melting metals, and JIS-SKD 61 steel is also used as an injection die or a structural member of an injection molding machine. Additionally JIS-SKD 61 steel has generally been applied to hot dies for casting steel applied to hot dies for casting steel materials.

The life of JIS-SKD 61 steel in these uses is ended by various causes, which are roughly divided into the following three factors. The first factor is softening due to long-term use in high temperature. JIS-SKD 61 steel has a structure of tempered martensite in which carbides are finely dispersed to serve for strengthening. However, while it is exposed to high temperature for a long time, dislocations restore, and the carbide grains agglomerate to become coarse. As a result, the material fails to retain its initial characteristics and is gradually softened. The second factor is cracks called a heat check. A heat check is cracks occurring on the material surface in a tortoiseshell pattern, which can be seen as ascribed to cyclic abrupt heating and cooling. The third factor is a melt loss phenomenon. Since a molten metal or alloy is highly reactive, the material surface in contact with a molten metal or alloy gradually undergoes denaturation and consumption.

Thus, JIS-SKD 61 steel that has been used conventionally tends to have poor durability on account of its insufficient resistance against high temperature softening, a heat check and a melt loss.

SUMMARY OF THE INVENTION

In the light of the above-mentioned situation, an object of the present invention is to provide hot working die steel which is excellent in high temperature softening resistance, heat check resistance, and melt loss resistance.

Another object of the present invention is to provide a member for high-temperature use comprising the hot working die steel.

The inventors of the present invention have conducted extensive testing on a large number of SKD 61 steel-based materials to examine the influences of alloying elements in high temperature softening resistance, heat check resistance, and melt loss resistance. They have found, as a result, that an optimized balance of the proportion of alloying elements provides a novel alloy composition much superior to SKD 61 steel in these characteristics.

The invention provides in its first aspect hot working die steel containing 0.10 to 0.50% of C, 0.5% or less of Si, 1.5% or less of Mn, 1.5% or less of Ni, 3.0 to 13.0% of Cr, 0 to 3.0% of Mo, 1.0 to 8.0% of W, 0.01 to 1.0% of V, 0.01 to 1.0% of Nb, 1.0 to 10.0% of Co, 0.003 to 0.04% of B, and 0.005 to 0.05% of N, the balance comprising Fe and unavoidable impurities, wherein all the percents are by weight (hereinafter the same).

In preferred embodiments of the first aspect of the invention, the hot working die steel further contains one or more of 0.001 to 0.05% of a rare earth metal (hereinafter abbreviated as REM), 0.001 to 0.05% of Mg, and 0.001 to 0.05% of Ca;

the total content of Co and W is 5.0% or more;

the B to N ratio ranges from 0.2 to 1.0, and the total content of B and N is 0.05% or less; or the total amount of all alloying elements except Fe is 15.0% or more.

The invention also provides in its second aspect a member for high-temperature use, such as a casting die, a structural member for a casting machine, an injection die, a structural member for an injection molding machine, a hot forging die or an extrusion die, which comprises the die steel according to the first aspect of the invention.

According to the present invention, hot working die steel superior to SKD 61 steel in high temperature softening resistance, heat check resistance, and melt loss resistance is provided. A casting die, a structural member for a casting machine, an injection die, a structural member for an injection molding machine or a hot forging die made of the die steel of the invention has considerably extended life. Therefore, the die steel of the invention is extremely useful in industry.

DETAILED DESCRIPTION OF THE PREFERRED EMBODIMENTS

Figure 1:
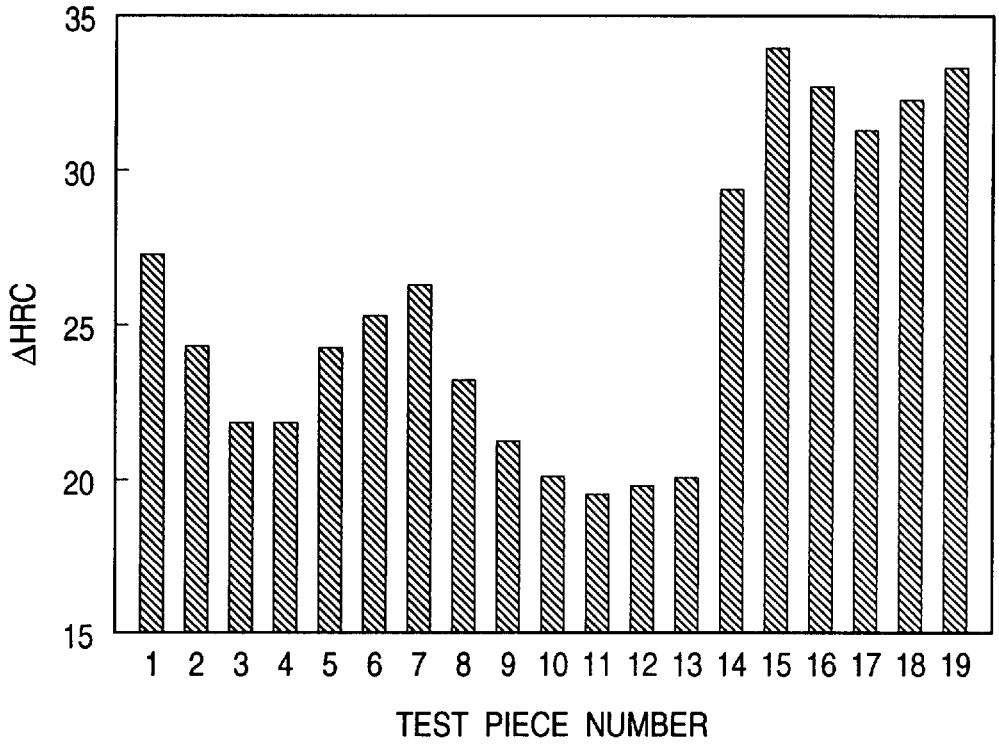
FIG. 1 is a graph showing the ΔHRC, a reduction in hardness due to heat treatment at 700° C. for 100 hours.

The grounds of limitations on the content of each alloying element will be described.

C is an element accelerating martensitic transformation, forming a solid solution in the matrix. It is an essential element for securing hardenability. It is also essential for forming carbides with other elements of the alloy, such as Fe, Cr, Mo, W, V, and Nb, to heighten high temperature strength. That is, C is an essential element for assuring the minimum strength, hardness, wear resistance, and the like required as die steel for hot working. In order to exploit these effects, C should be present in an amount of at least 0.10%. Too high a C content, however, is liable to make the carbides excessively coarse, which causes reduction in high temperature strength, giving adverse influences on high temperature softening resistance or heat check resistance. Therefore, the C content should fall within a range of from 0.10 to 0.50%.

For the same reasons, the lower and upper limits of the C content are preferably 0.15% and 0.40%, respectively.

Si is used as a deoxidizing element in melting process of an alloy and therefore remains in the alloy as an unavoidable impurity. Because Si accelerates the carbides' getting coarse or forms intermetallic compounds called a Laves phase which noticeably impairs toughness of the alloy, it is desirable to minimize the Si content. For this reason the Si content should be not more than 0.5% and is preferably 0.3% or less.

Mn is an element useful as a deoxidizing element similarly to Si and also contributory to improvement of hardenability. On the other hand, too high an Mn content incurs reductions in toughness and high temperature strength, adversely affecting the high temperature softening resistance and heat check resistance. Therefore, the Mn content should be 1.5% or less, preferably 1.0% or less.

Ni is effective in improving toughness, enhancing hardenability, and suppressing δ-ferrite formation. Too high an Ni content, however, impairs high-temperature structure stability so that the alloy is apt to undergo changes with time, and the high temperature softening resistance and heat check resistance would be deteriorated. For this reason, the upper limit of the Ni content is set at 1.5%, preferably 1.0%.

Cr is indispensable to hot working die steel. It not only secures oxidation resistance and resistance to high temperature corrosion but forms a carbide with C to heighten the strength. Cr also improves melt loss resistance because of its high stability against molten metal. To obtain these effects, it should be added in an amount of at least 3.0%. If added in excess, Cr fosters δ-ferrite formation, inviting reductions in toughness and high temperature strength. Therefore, the Cr content should range from 3.0 to 13.0%, preferably from 5.0 to 11.0%.

Mo, while not essential, is added for preference. Mo forms a solid solution in the matrix to improve high temperature strength.

It is effective in promoting fine precipitation of carbides and preventing agglomeration of the precipitated carbides. Further, it exhibits high stability to molten metal to improve melt loss resistance. Addition of too much Mo accelerates formation of δ-ferrite to invite reductions in toughness and high temperature strength. Accordingly, the Mo content is limited to 3.0% or smaller. A preferred upper limit is 2.0%.

W forms a solid solution in the matrix to improve high temperature strength. It is effective in promoting fine precipitation of carbides and preventing agglomeration of the precipitated carbides. It also achieves improved melt loss resistance owing to its high stability to molten metal. These effects produced by W are greater than those observed with Mo, bringing about marked improvements on high temperature softening resistance, heat check resistance, and melt loss resistance. Hence, W is an indispensable element to be added. It should be added in an amount of at least 1.0% so as to exploit the full performance. Too high a W content, however, fosters formation of δ-ferrite and a Laves phase to incur reductions in toughness and high temperature strength. Therefore, the W content should fall within a range of from 1.0 to 8.0%. For the same reasons, a preferred W content is from 2.0 to 7.0%.

V is bonded to C to form a carbide contributory to improvements in high temperature strength and wear resistance. It should be added in an amount of at least 0.01% in order to manifest its effects. However, too much V tends to form excessively coarse carbide grains, which will reduce the high temperature strength to impair high temperature softening resistance and heat check resistance. From this viewpoint, the V content should range from 0.01 to 1.0%. A preferred V content is from 0.1 to 0.5%.

Nb is bonded to C to form fine carbide grains, making a contribution to the improvement of high temperature strength and to reduction of the crystal grain size. To obtain these effects, Nb should be added in an amount of at least 0.01%. Too high an Nb content is liable to make the carbide excessively coarse, which will reduce the high temperature strength and toughness to adversely affect the high temperature softening resistance and heat check resistance. From this standpoint, the Nb content should be 0.01 to 1.0%. A preferred Nb content is from 0.5 to 0.5%.

Co dissolves in the matrix to form a solid solution to enhance the high temperature strength and impact resistance and therefore brings about improvements in high temperature softening resistance and heat check resistance. It suppresses precipitation of δ-ferrite and prevents reductions in high temperature strength and toughness. It also improves melt loss resistance of the alloy because of its high stability to molten metal. Co is therefore indispensable to the die steel of the invention. To obtain the above effects, Co should be added in an amount of at least 1.0%. Because Co is very expensive, use of more Co than necessary results in increased material cost. Taking the foregoing into consideration, the Co content should range from 1.0 to 10.0% and preferably from 2.0 to 8.0%.

Seeing that Co has benign influences on all the high temperature softening resistance, heat check resistance and melt loss resistance, it is preferred that Co be added in an increased amount within the above range to bring the improvements on these characteristics. It is noted that W, which acts similarly to Co, and Co are mutually complementary to some extent so that part of expensive Co can be substituted with W. In this connection, it is desirable that the total content of Co and W be 5.0% or more, preferably 8.0% or more, particularly where excellent characteristics in high temperature softening resistance, heat check resistance and melt loss resistance are demanded.

B is segregated mainly on grain boundaries to exert a stabilizing effect on the grain boundaries even in a trace amount. This function of B restrains high temperature change of the structure with time to retain high temperature strength for a long time and to subdue crack initiation or propagation, leading to significant improvements in high temperature softening resistance and heat check resistance. To obtain these effects, B should be added in an amount of at least 0.003%. Addition of too much B leads to reduction in ductility or toughness, resulting in deterioration particularly of high temperature softening resistance and heat check resistance. Accordingly, the B content is limited within a range of from 0.003 to 0.04%, preferably 0.005 to 0.02%.

N is bonded to Cr, V, Nb, etc. in the alloy to form nitrides or carbonitrides which increase the high temperature strength and reinforce the matrix. It also improves high temperature anticorrosion and strength. To obtain these effects, N is added in an amount of at least 0.005%. Since too much N deteriorates weldability and hot workability, the N content is limited to a range 0.005 to 0.05%. A preferred N content is from 0.01 to 0.04%.

There is a specific mutual relationship between B and N. In order to secure sufficient improvement in high temperature softening resistance and heat check resistance, it is preferred that the ratio of B content to N content, i.e., B/N ratio be from 0.2 to 1.0. While the reason is unclear for the time being, the mutual relationship between B and N is suggested by the fact that compounds composed of B and/or N are found formed in the alloy or co-segregated on the grain boundaries between B and N or around carbide grains. A still preferred B/N ratio ranges from 0.3 to 0.7.

As stated previously, presence of too much B or N incurs reductions of high temperature ductility or toughness. This tendency increases synergistically where both B and N are present. In particular when the total content of B and N exceeds 0.05%, the high temperature toughness and ductility diminish to deteriorate hot workability, which would lead to another processing problem. Therefore, the total content of B and N is preferably 0.05% or smaller, still preferably 0.04% or smaller.

Stability to molten light metal can further be improved by decreasing the relative proportion of Fe in the alloy probably because the reaction between the alloy of the invention and a molten light metal, e.g., Al, seems to be based chiefly on a reaction between Fe of the alloy and the molten light metal. It is desirable that the total content of the alloying elements except Fe be 15.0% or greater, particularly 18.0% or greater.

REM, Mg, and Ca function as a deoxidizing and desulfurizing element during melting and smelting and, at the same time, exert great effects on high temperature strength and high temperature ductility. In addition an REM is effective in improving oxidation resistance and prevents propagation of cracks. These effects eventually contributing to the improvement in heat check resistance, one or more of REM, Mg and Ca can be added in an amount of from 0.001 to 0.05% each, preferably from 0.005 to 0.03% each, if desired. Excessive addition of these elements can result in serious impairment of hot workability.

The alloy steel according to the present invention can be used as hot working die steel that is used at relatively high temperature. For example, it is useful as a material of a casting die, a structural member for a casting machine, an injection die, a structural member for an injection molting machine, a hot forging die, and an extrusion die. The use of the alloy steel of the invention is by no means limited thereto, and the alloy steel is widely applicable to uses in relatively high temperature.

The alloy steel of the invention can be produced in a usual manner. For example, a mixture having a predetermined composition is melted by electric furnace melting or vacuum induction melting (VIM), and the molten mixture is cast into an ingot of prescribed shape. If necessary, the ingot is remelted in an electroslag remelting (ESR) furnace or a vacuum arc remelting (VAR) furnace, followed by casting. The cast alloy can be subjected to a treatment for homogeneous diffusion, if desired, and worked to a desired shape by various working methods such as forging, and rolling, followed by annealing. Thereafter the workpiece is subjected to a heat treatment, such as hardening or tempering, to acquire desired mechanical characteristics and machined to size. Alternatively, the cast alloy is first machined and then subjected to a heat treatment, such as hardening or tempering, to acquire desired mechanical characteristics, followed by finishing. Members thus manufactured, such as a casting die, a structural member for a casting machine, an injection die, a structural member for an injection molding machine, and a hot forging die, are excellent in high temperature softening resistance, heat check resistance, and melt loss resistance and therefore have an appreciably much longer life than those made of SKD 61 steel.

The present invention will now be illustrated in greater detail with reference to Example.

EXAMPLE

Materials having the compositions shown in Table 1 below were each cast into a 50 kg ingot in a VIM furnace. In Table 2 below are shown the total content of Co and W (Co+W), the total content of B and N (B+N), the B to N ratio (B/N), and the total amount of all alloying elements except Fe (Σ). Sample No. 19 corresponds to SKD 61 steel.

Each ingot was subjected to a homogeneous diffusion treatment and worked into a 30 mm thick and 120 mm wide plate by hot forging. Test pieces cut out of the plate were heated at 1050° C. for 3 hours followed by air cooling (hardening).

TABLE 1

| | | Composition (wt %) | | | | | | | | | | | | | | | |
|---|---|---|---|---|---|---|---|---|---|---|---|---|---|---|---|---|---|
| Sample No. | | C | Si | Mn | Ni | Cr | Mo | W | V | Nb | Co | B | N | REM | Mg | Ca | Fe |
| Invent- | 1 | 0.20 | 0.11 | 0.10 | 0.21 | 9.90 | — | 1.85 | 0.21 | 0.06 | 3.01 | 0.0110 | 0.0193 | — | — | — | BL* |
| ion | 2 | 0.20 | 0.10 | 0.10 | 0.21 | 10.04 | — | 3.99 | 0.21 | 0.06 | 3.03 | 0.0120 | 0.0189 | — | — | — | BL |
| | 3 | 0.19 | 0.10 | 0.09 | 0.20 | 10.05 | — | 5.96 | 0.20 | 0.06 | 3.05 | 0.0110 | 0.0232 | — | — | — | BL |
| | 4 | 0.16 | 0.12 | 0.10 | 0.21 | 10.09 | — | 3.97 | 0.21 | 0.05 | 5.04 | 0.0120 | 0.0225 | — | — | — | BL |
| | 5 | 0.21 | 0.13 | 0.11 | 0.20 | 9.91 | — | 3.03 | 0.21 | 0.06 | 5.03 | 0.0120 | 0.0194 | — | — | — | BL |
| | 6 | 0.25 | 0.12 | 0.10 | 0.21 | 9.87 | — | 3.97 | 0.21 | 0.06 | 5.03 | 0.0110 | 0.0214 | — | — | — | BL |
| | 7 | 0.19 | 0.11 | 0.10 | 0.05 | 9.44 | 1.51 | 3.98 | 0.20 | 0.05 | 7.55 | 0.0035 | 0.0188 | — | — | — | BL |
| | 8 | 0.22 | 0.12 | 0.11 | 0.05 | 0.35 | 1.47 | 3.02 | 0.20 | 0.04 | 7.43 | 0.0070 | 0.0188 | — | — | — | BL |
| | 9 | 0.21 | 0.12 | 0.11 | 0.05 | 9.27 | 1.49 | 2.99 | 0.20 | 0.04 | 7.51 | 0.0110 | 0.0192 | — | — | — | BL |
| | 10 | 0.20 | 0.11 | 0.10 | 0.04 | 9.50 | 1.48 | 2.97 | 0.21 | 0.04 | 7.52 | 0.0160 | 0.0223 | — | — | — | BL |
| | 11 | 0.21 | 0.10 | 0.12 | 0.06 | 9.33 | 1.50 | 3.09 | 0.22 | 0.05 | 7.82 | 0.0060 | 0.0190 | 0.0090 | — | — | BL |
| | 12 | 0.20 | 0.10 | 0.10 | 0.05 | 9.01 | 1.30 | 2.50 | 0.20 | 0.04 | 8.00 | 0.0100 | 0.0180 | — | 0.0080 | — | BL |
| | 13 | 0.20 | 0.11 | 0.10 | 0.04 | 9.50 | 1.48 | 2.97 | 0.21 | 0.04 | 7.52 | 0.0160 | 0.0223 | — | — | 0.0060 | BL |
| Com- | 14 | 0.19 | 0.11 | 0.11 | 0.05 | 9.95 | 1.45 | 3.14 | 0.20 | 0.04 | 7.50 | 0.0005 | 0.0190 | — | — | — | BL |
| parison | 15 | 0.25 | 0.12 | 0.13 | 0.21 | 8.04 | 1.44 | — | 0.57 | — | — | 0.0110 | 0.0182 | — | — | — | BL |
| | 16 | 0.36 | 0.11 | 0.10 | 0.20 | 8.21 | 1.35 | 0.75 | 0.61 | 0.05 | 0.74 | 0.0110 | 0.0216 | — | — | — | BL |
| | 17 | 0.35 | 0.10 | 0.09 | 0.20 | 8.05 | — | 2.99 | 0.60 | — | — | 0.0005 | 0.0190 | — | — | — | BL |
| | 18 | 0.35 | 0.15 | 0.12 | 0.22 | 8.01 | 1.52 | — | 0.60 | — | 1.05 | 0.0005 | 0.0223 | — | — | — | BL |
| Conven- | 19 | 0.37 | 1.06 | 0.37 | 0.10 | 5.26 | 1.32 | — | 0.92 | — | — | 0.0005 | 0.0161 | — | — | — | BL |
| tional | | | | | | | | | | | | | | | | | |

*Balance

TABLE 2

| Sample No. | | B + N (wt %) | B/N | C0 + W (wt %) | Σ* (wt %) |
|---|---|---|---|---|---|
| Invention | 1 | 0.0303 | 0.57 | 4.86 | 15.76 |
| | 2 | 0.0309 | 0.63 | 7.02 | 17.97 |
| | 3 | 0.0342 | 0.47 | 9.01 | 19.93 |
| | 4 | 0.0345 | 0.53 | 9.01 | 19.98 |
| | 5 | 0.0314 | 0.62 | 9.01 | 19.87 |
| | 6 | 0.0324 | 0.51 | 9.00 | 19.85 |
| | 7 | 0.0223 | 0.19 | 10.58 | 22.25 |
| | 8 | 0.0258 | 0.37 | 10.45 | 22.04 |
| | 9 | 0.0302 | 0.57 | 10.50 | 22.02 |
| | 10 | 0.0383 | 0.72 | 10.49 | 22.21 |
| | 11 | 0.0250 | 0.32 | 10.91 | 22.53 |
| | 12 | 0.0280 | 0.56 | 10.50 | 22.53 |
| | 13 | 0.0383 | 0.72 | 10.49 | 22.21 |
| Comparison | 14 | 0.0195 | 0.03 | 10.64 | 22.76 |
| | 15 | 0.0292 | 0.60 | — | 10.79 |
| | 16 | 0.0326 | 0.51 | 1.49 | 12.51 |
| | 17 | 0.0195 | 0.03 | 2.99 | 12.40 |
| | 18 | 0.0228 | 0.02 | 1.05 | 12.04 |
| Conventional | 19 | 0.0166 | 0.03 | — | 9.42 |

*[1]Σ = total amount of alloying elements except Fe

The thermomechanical characteristics of the test pieces were evaluated as follows.

1) High Temperature Softening Resistance

The test piece after hardening was kept at 700° C. for 100 hours and then air-cooled. The surface of the cooled test piece was mirror polished, and the hardness was measured with a Rockwell hardness tester (scale C) to obtain the change of hardness (ΔHRC) due to the heat treatment. The results obtained are shown in FIG. 1. The smaller the ΔHRC, the higher the high temperature softening resistance. It is apparent from FIG. 1 that the materials of the invention are superior in high temperature softening resistance to the comparative or conventional materials.

2) Heat Check Resistance

Figure 2:
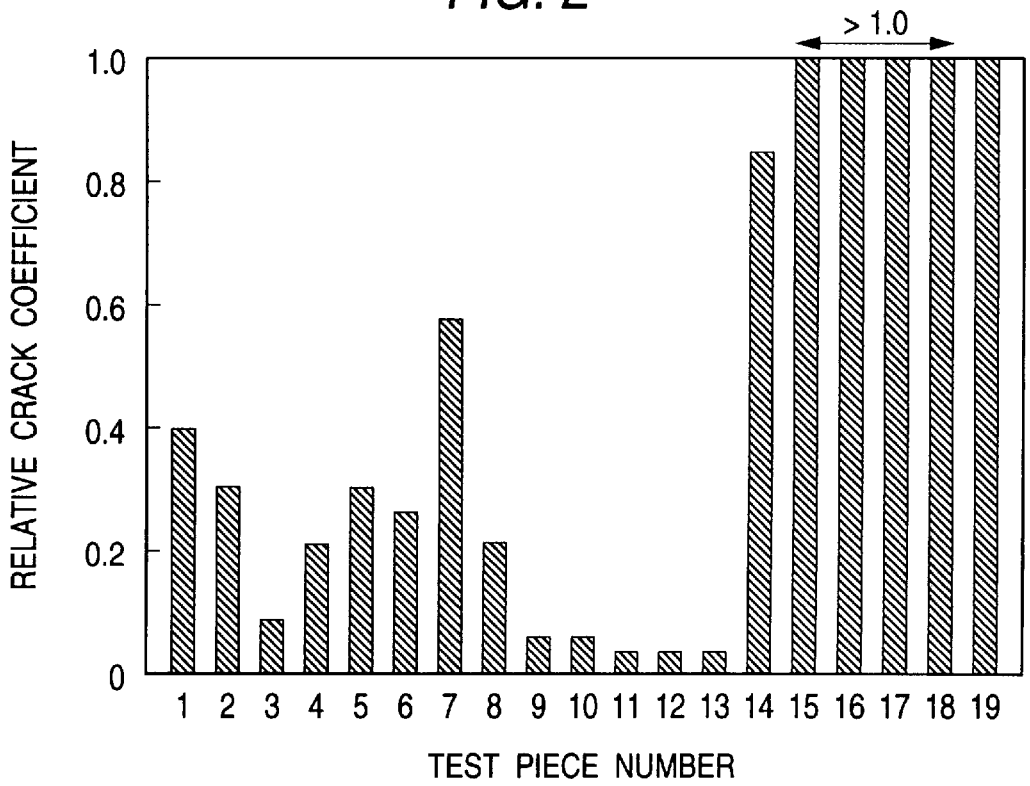
FIG. 2 is a graph of the relative crack coefficient, a ratio of the total crack length of a sample to that of conventional SKD 61 steel.

A heat check test was carried out on the test piece by means of a tester made by the applicant. The test piece was exposed to 1000 heat cycles each consisting of heating the surface of the test piece to 630° C. immediately followed by cooling with water. The test piece was cut, and cracks having developed on the cut surface were observed under an optical microscope. The number of all the cracks appearing in a 10-mm length at the center of the test specimen and the length of each of the cracks were recorded. The lengths of the cracks were added up to obtain a total crack length. The ratio of the total crack length to that of conventional SKD 61 steel (sample No. 19) was taken as a relative crack coefficient. The smaller the relative crack coefficient, the higher the heat check resistance. The results of measurement are shown in FIG. 2. It is obvious that the samples according to the present invention are superior to the comparative sample and the conventional sample in heat check resistance. Among the samples of the invention, it can be seen that those containing at least one of REM, Mg, and Ca (sample Nos. 11, 12 and 13) exhibit still superior results in heat check resistance.

3) Melt Loss Resistance

Figure 3:
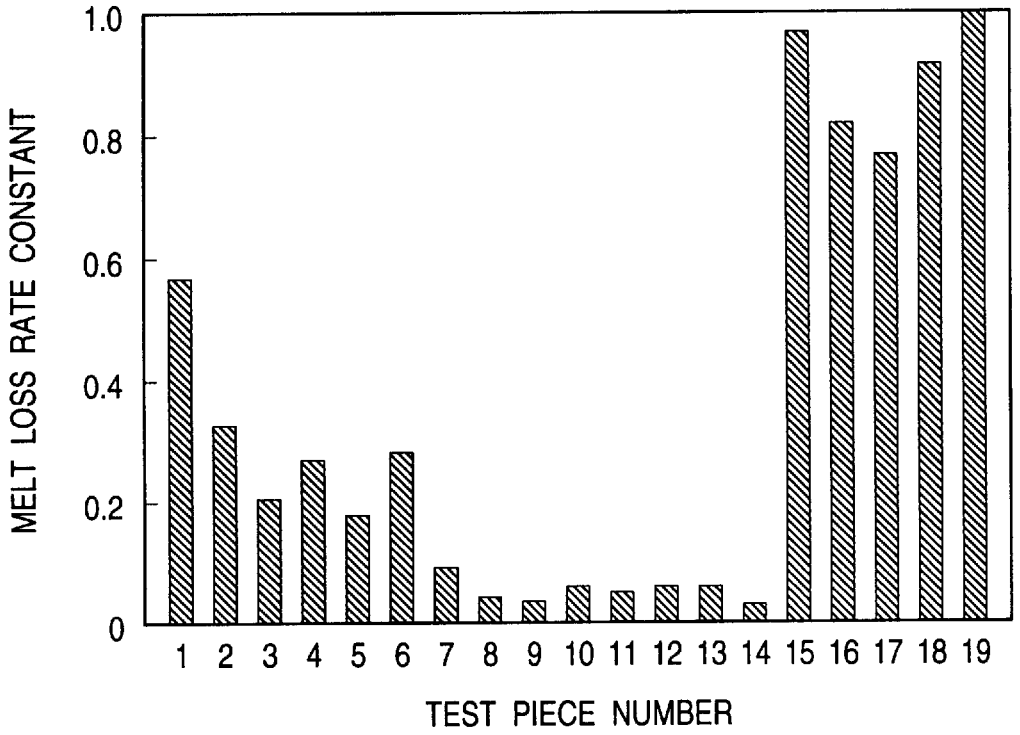
FIG. 3 is a graph of the melt loss rate constant of samples relative to that of SKD 61 steel.

A melt loss test was carried out on the test piece by means of a tester made by the applicant. The test piece was rotated in a molten Al—Mg alloy kept at 650° C. for 100 hours at the longest. An overall melt loss of the test piece was obtained as a weight change after the test. From the overall melt loss were calculated a melt loss per unit area and unit time and a melt loss rate constant. A ratio of the melt loss rate constant of the test piece to that of SKD 61 steel (sample No. 19) was taken as a relative melt loss rate coefficient. The smaller the relative melt loss rate coefficient, the higher the melt loss resistance. The results obtained are shown in FIG. 3, from which it is apparent that the materials according to the invention are superior to the conventional material in melt loss resistance. In particular, the materials of the invention whose Σ is 18% or higher were proved to exhibit excellent melt loss resistance almost equally to pure cobalt. It is apparent from FIGS. 1 and 2 that the comparative sample No. 14 is, while equal to the samples of the invention in melt loss resistance, inferior in high temperature softening resistance and heat check resistance.

Performance of the die steel of the invention in actual use was evaluated as follows.

Separately from the above testing, the rare materials constituting sample No. 7, 11, 14 (comparative) or 19 (conventional) were melted in a VIM furnace. The resulting ingot was remelted in an ESR furnace and cast to prepare an ingot having a diameter of 260 mm. After being subjected to a homogeneous diffusion treatment, the ingot was forged into a rod having a diameter of 200 mm, followed by annealing. The rod was subjected to a hardening treatment at 1050° C. and a tempering treatment at 600 to 650° C. and machined to a prescribed size and shape. An injection molding machine was constructed using the thus prepared parts.

Figure 4:
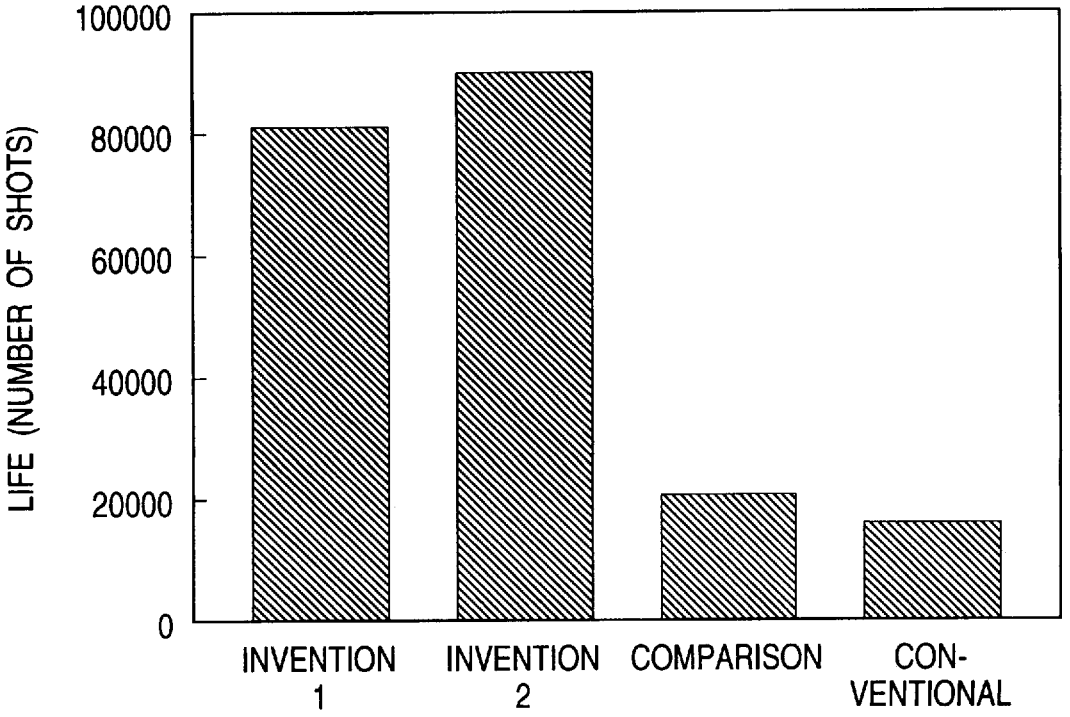
FIG. 4 is a graph of the life of a structural member constituting a magnesium injection molding machine.

Injection molding of a magnesium alloy was continuously carried out in the injection molding machine. The life of the injection molding machine (the number of shots) is graphed in FIG. 4. It is apparent that the materials of the invention have remarkably longer lives than the comparative or conventional materials.

According to the present invention, hot working die steel superior to SKD 61 steel in high temperature softening resistance, heat check resistance, and melt loss resistance is provided. A casting die, a structural member for a casting machine, an injection die, a structural member for an injection molding machine or a hot forging die made of the die steel of the invention has considerably extended life. Therefore, the die steel of the invention is extremely useful in industry.

What is claimed is:

1. Hot working die steel comprising: 0.10 to 0.50% by weight of C, 0.5% by weight or less of Si, 1.5% by weight or less of Mn, 1.5% by weight or less of Ni, 3.0 to 13.0% by weight of Cr, 0 to 3.0% by weight of Mo, 1.0 to 8.0% by weight of W, 0.01 to 1.0% by weight of V, 0.01 to 1.0% by weight of Nb, 1.0 to 10.0% by weight of Co, 0.003 to 0.04% by weight of B, and 0.005 to 0.05% by weight of N, the balance including Fe and unavoidable impurities.

2. Hot working die steel according to claim 1 further comprising: one or more of 0.001 to 0.05% by weight of a rare earth metal, 0.001 to 0.05% by weight of Mg, and 0.001 to 0.05% by weight of Ca.

3. Hot working die steel according to claim 1, wherein the total content of Co and W is 5.0% by weight or more.

4. Hot working die steel according to claim 2, wherein the total content of Co and W is 5.0% by weight or more.

5. Hot working die steel according to claim 1, wherein the B to N ratio ranges from 0.2 to 1.0, and the total content of B and N is 0.05% by weight or less.

6. Hot working die steel according to claim 2, wherein the B to N ratio ranges from 0.2 to 1.0, and the total content of B and N is 0.05% by weight or less.

7. Hot working die steel according to claim 3, wherein the B to N ratio ranges from 0.2 to 1.0, and the total content of B and N is 0.05% by weight or less.

8. Hot working die steel according to claim 4, wherein the B to N ratio ranges from 0.2 to 1.0, and the total content of B and N is 0.05% by weight or less.

9. Hot working die steel according to claim 1, wherein the total amount of all alloying elements except Fe is 15.0% by weight or more.

10. Hot working die steel according to claim 2, wherein the total amount of all alloying elements except Fe is 15.0% by weight or more.

11. Hot working die steel according to claim 3, wherein the total amount of all alloying elements except Fe is 15.0% by weight or more.

12. Hot working die steel according to claim 4, wherein the total amount of all alloying elements except Fe is 15.0% by weight or more.

13. Hot working die steel according to claim 5, wherein the total amount of all alloying elements except Fe is 15.0% by weight or more.

14. Hot working die steel according to claim 6, wherein the total amount of all alloying elements except Fe is 15.0% by weight or more.

15. Hot working die steel according to claim 7, wherein the total amount of all alloying elements except Fe is 15.0% by weight or more.

16. Hot working die steel according to claim 8, wherein the total amount of all alloying elements except Fe is 15.0% by weight or more.

17. The member according to any one of claims 1 to 16 which is a casting die, a structural member for a casting machine, an injection die, a structural member for an injection molding machine, a hot forging die or an extrusion die.

* * * * *